US005503234A

United States Patent [19]

Clanton

[11] Patent Number: 5,503,234

[45] Date of Patent: Apr. 2, 1996

[54] 2×4 DRILLING AND HOISTING SYSTEM

[76] Inventor: Duane Clanton, 3136 Hwy. 45 South, Waynesboro, Miss. 39367

[21] Appl. No.: 316,576

[22] Filed: Sep. 30, 1994

[51] Int. Cl.[6] ..... E21B 19/06

[52] U.S. Cl. ..... 175/52; 175/162; 175/203

[58] Field of Search ..... 175/52, 85, 162, 175/195, 203

[56] References Cited

U.S. PATENT DOCUMENTS

| | | | |
|---|---|---|---|
| 3,365,008 | 1/1968 | Zimmerman et al. | 175/85 |
| 3,613,906 | 10/1971 | Deyo et al. | 175/85 |
| 3,949,818 | 4/1976 | Russell | 175/52 |
| 4,605,077 | 8/1986 | Boyadjieff | 175/85 |
| 4,738,321 | 4/1988 | Olivier | 175/85 |
| 4,765,401 | 8/1988 | Boyadjieff | 175/52 X |
| 4,862,973 | 9/1989 | Voigts et al. | 175/85 X |
| 5,244,329 | 9/1993 | McGill et al. | 175/52 X |
| 5,265,683 | 11/1993 | Krasnov | 175/52 |
| 5,351,767 | 10/1994 | Stongner et al. | 175/162 |

*Primary Examiner*—Frank S. Tsay

*Attorney, Agent, or Firm*—Pravel, Hewitt, Kimball & Krieger

[57] ABSTRACT

A drilling and hoisting system that mounts a rotating elevator, providing lift and rotation for a drill string, on a horizontal platform assembly, together with all necessary drive motors and ancillary pipe handling equipment. This platform is suspended from balanced dual crown blocks driven by a double drum draw works. This rotary elevator platform opens up the center of the drill rig for pipe handling. Pipe is handled by the elevator by gripping the pipe at a tool joint; the pipe stand may extend above the rotary elevator. A keyhole in the crown assembly of the drill rig passes the upper end of pipe stands to a light weight stand jib crane which racks pipe stands against a ground level pipe rack. The height of the rig mast no longer limits the maximum length of pipe stand which can be handled, and four section stands can be handled in a rig having a mast under 100 feet high.

6 Claims, 8 Drawing Sheets

2× 4 DRILLING AND HOISTING SYSTEM

RELATED DOCUMENTS

This application relates to the Disclosure Document 340207, filed 30 September 1993 in the files of the United States Patent Office, which is incorporated in full herein.

BACKGROUND OF THE INVENTION

The area of the invention is drilling rigs for deep oil and gas boreholes, and for the equipment within the drilling rig for handling and maneuvering the drill string.

The standard form of drilling rig utilized today consists of two major structural components which are addressed by the invention. The first is a substructure with sufficient height to accommodate a stack of blow out preventers (BOP) underneath the substructure, and with sufficient strength to support the entire drilling rig and drill string. A rotary table mounted at the substructure floor drives the string while drilling and supports the drill string, by means of removable slips and elevators, during makeup and break out of the string. When the string is removed from the borehole, it is racked (stored) on the substructure in a setback area, at rig floor level.

The second component is the mast, which is mounted onto and above the substructure. This mast must have sufficient height to accommodate a drill pipe stand, together with all hoisting tools (block, lines, hook, links, and elevators) required to hoist the pipe string. Drill string is usually handled as three joined sections, or joints, of standard drill pipe which are coupled together; each joint of standard drill pipe is approximately 31 (thirty-one) feet long, and this triple section is therefore about 93 feet long. Thus the working height of the mast must be the combination of the stand (93 feet), the tools (usually 30 feet), an attachment working area above the substructure floor (about 4 feet), and a safety factor between the top of the hoisting block and the mast crown (about 10 feet). This is a minimum of 137 feet; in fact the typical large rig has a 142 foot mast mounted on a 25 to 30 foot high substructure.

It is apparent then that all the height and bulk of the mast and substructure combination, beyond that required to add drill pipe to the string (make connections) and to support the drill string suspended down hole, is to accommodate the handling of string in units of more than one joint. This is a trade off between rig complexity and size versus the time saved when making trips from not having to make up every joint connection each time the drill string is placed or removed. If it were not for this need to save time by setting back pipe in lengths greater than single joints, no rig would have cause to be higher than a height to accommodate the hoisting tools, the kelly and one joint of pipe.

Several structures have addressed the need to increase the efficiency of this conventional pipe handling.

U.S. Pat. No. 3,266,582 TO HOMANICK discloses a drilling rig using horizontal racking of the drill pipe and a specifically designed drill head suspension assembly. A traveling block assembly which has two spaced apart sheaves axially aligned, one on each side of the center line of the drill rig is disclosed. The traveling block is a centrally suspended single traveling block handling the drill string from the top end.

U.S. Pat. No. 4,738,321 TO OLIVIER discloses a mechanism for handling a drill pipe by a gripper which clutches the pipe at a mid-point and which moves the gripped stand of pipe to a fingerboard for vertical rack storage. FIG. 2 appears to show the mechanism handling a double stand of pipe. Again, the pipe is positioned by a traveling block connected to the top end of the drill string.

U.S. Pat. No. 3,633,771 TO WOOLSLAYER ET AL. discloses a mechanism for handling a pipe triple for racking for horizontal storage. The mechanism is a double grip on a manipulable vertical beam which can be folded to place the pipe along a horizontal storage rack. The pipe string however is handled by a top end traveling block; the mechanism serves only to grip the pipe and does not otherwise support or manipulate the drill string.

U.S. Pat. No. 3,613,906 TO DEYO ET AL. discloses a drill pipe storage and racking mechanism for moving the pipe horizontally while in a vertical position out of the center line of the drill rig. The mechanism is notable in that it holds both the upper and lower end of the drill pipe; otherwise, there is no manipulation of the drill string or the pipe.

U.S. Pat. No. 4,440,536 TO SCAGGS discloses a mechanism for aligning drill pipe during the threading and unthreading operations; the device basically replaces the stabber and holds and aligns the pipe horizontally during the threading and unthreading. The pipe, however, remains suspended from a central traveling block and apparently tongs and the like are required to actually rotate the pipe.

U.S. Pat. No. 5,244,329 TO MCGILL ET AL. shows a mechanism for handling a pipe triple within a fingerboard of a vertical pipe rack, comprising a set of upper and lower mounted jaws connected to operating arms which grip and position the pipe.

U.S. Pat. No. 5,265,683 TO KRASNOV shows a moving rotary drive system for replacing the Kelly or Kelly Bushing. The rotary bushing is mounted on a mobile platform which is raised or lowered a distance above the rotary table by means of hydraulic cylinders. The invention discloses a gripper system for gripping and rotating a pipe within the moveable platform. The platform is described as being moveable upward or downward a selected distance for drilling and reaming operations. The pipe string itself is still raised and lowered by means of a traveling block and crown assembly.

U.S. Pat. No. 3,365,008 TO ZIMMERMAN ET AL. discloses, as part of a drilling rig for drilling ultra large diameter holes, the structural concept of constructing the drilling rig in the form of two parallel spaced apart vertical load-supporting members with the pipe handling equipment being suspended between the load supporting members.

SUMMARY OF THE INVENTION

This Invention pertains to drill rigs, particularly to the equipment within the drilling rig for handling and maneuvering the drill string pipe.

Routine rig operations within a drilling rig, notably trips, connections, and running casing, require extreme attention, skill and timing by crew members working together in order to safely make up and trip a continuing string of drill pipe during working operations.

The invention addresses the need for setting back pipe in multiple joints to save time in rig operations, while reducing the size and bulk of the overall rig, by a unique equipment arrangement allowing the inventive rig to handle multiples of four joints, or fourbles, each approximately 124 feet long, within a system which has a reduced mast height requirement, by pulling this fourble as two double joint sections—by pulling doubles—twice per breakout. The invention provides a rotating drive comparable to a "top drive", while eliminating the manual latching of the elevators and the manual walking of pipe to the setback area. Further the invention allows the rig to be modified to support the setback of pipe on a ground level pipe rack, reducing the substructure required to support a setback area.

The Invention mounts a rotovator, a modification of a rotary table, with a coupled set of remotely operated tool joint grips, mounted on a horizontal platform assembly, together with all necessary drive motors and ancillary pipe handling equipment, and suspends this platform from a balanced dual drum and sheave arrangement driven by a double drum draw works. This platform is preferably suspended through an equalizer bar to insure the platform remains level under varying loads.

The crown sheaves are split into two balanced sections. Since these sheaves sections share the load, each section is lighter, as the balanced support also allows utilizing smaller wire rope. The crown itself has a keyhole center through which stand removal or addition is made. It is supplemented by a light weight stand jib crane which is only required to handle individual stands of pipe, not more than four sections (a fourble) at a time.

By using a dual draw works for lifting the rotovator platform from balanced sheaves, one coupled to links at each end of the platform, the strain of the weight of handling the drill string is halved, and, further, the loads are distributed more over the legs of the mast, significantly reducing the overall stresses within the drill rig structure.

This mobile rotary platform, or "rotovator", has the additional advantage that the rotary therein is specifically sized and equipped with jaws for coupling to and handling only the drill string and the tool joints of the drill string. The rotovator opening is thus smaller than for conventional floor mounted rotary tables. In addition, because the rotovator is on a moving beam assembly, the drill string may be handled by grasping and moving multiple joints of pipe at a time by the Rotovator.

In particular, the assembly can raise pipe and remove it while tripping out in sections of four joint stands or fourbles. The drill string is stiff enough in typically encountered drill string sizes that the fourble may be gripped by this rotary table at the middle tool joint; that is, two joints are above the rotovator and two beneath the Rotovator while raising the string. The upper section of the drill string is guided in position by a provided crown funnel guide and keyhole which maintains the pipe in alignment and guides it into position for gripping by the stand jib. Thus the Invention effectively handles pipe in stands of four joints, yet by gripping and pulling at every other tool joint, effectively pulls pipe in doubles.

As a result, the rotovator assembly allows drill pipe to be pulled in double sections and set back in quadruple sections, yet the mast height is considerably shortened inasmuch as there is no drill pipe hoisting equipment above the drill pipe.

The Invention is also particularly amenable to providing for ground level racking of drill string, under the control of the derrickman, with consequent lessening of the substructure loads.

The apparatus is particularly amenable to partial or total automation of the overall drill pipe handling operation. Particularly, in conjunction with prior art mechanical tongs, such as the "Iron Rufnek"™, and with the addition of a stabbing arm to the rotovator, practically total automation of the pipe handling is possible.

The Invention eliminates the need for the hook and swivel, the kelly, kelly drive, and kelly spinner, catwalks and pipe racks. It also reduces the bulk and height which formerly had to be built into the substructure and mast in prior art drill rigs.

The invention, by placing the draw works at ground level, eliminates the need for a substructure mount for draw works and catworks.

By centralizing operations, all three crew members can have in door protected work stations.

The apparatus is particularly useful in allowing for three man tripping, freeing up the fourth and fifth crew member normally required for trips on a conventional drill rig.

Inasmuch as the rig is capable of removing quadruple sections at a time, it decreases the trip time, by allowing for one-third more pipe per breakout on trips.

By handling the four joint pipe stands two joints at a time and by balancing the loads of the lifting lines, the motion of the pipe handling equipment is made more nearly constant. Both the maximum speed needed on the lines and the loads on the lines are significantly decreased. This eliminates the danger of running into the crown while racing the empty blocks up after a stand of pipe.

Of great economic importance, the overall heighth of the rig is considerably shortened over that required for a conventional drill rig capable of handling triple sections in a trip. Since the rig is sufficiently shortened and lightened by the shortened mast, there is significantly less rig structure to move from drill site to drill site and, therefore, a significant reduction in cost (See FIG. 16). In comparison to a conventional 142 foot mast rig with a 25 to 30 foot high box and box substructure, the invention comes to almost 43% fewer movement loads, comparing only the components affected (i.e. drawworks, mud pumps, etc would be the same). Compared to a self elevating substructure, the inventive system shows a 21.4% advantage in moving loads. There is less rig to move and to rig up, and most of the rig components are lighter than their counterpart structures in conventional rigs. The inventive design should lend itself well to remote operations as the components are both fewer and lighter than for conventional rigs.

Thus, it is an object of this Invention to disclose an improved drilling rig system which permits the handling of multiple pipe sections during trips in and out, but a system which greatly reduces the height and bulk of the mast and substructure.

It is a further object of the Invention to disclose an improved drilling rig system which permits greater automation and fewer menial tasks during drill pipe handling.

It is a further object of the Invention to disclose an improved drill pipe handling system which permits a shorter, lesser cost drilling rig to handle deep down hole drilling strings.

It is a further object of the Invention to disclose a drilling rig which requires less concentrated strain and stress on the draw works and drill string handling equipment for handling a given heavy weight long length drill string.

These and other objects of the Invention will be more clearly seen from the detailed description of the preferred embodiment which follows.

DETAILED DESCRIPTION OF THE INVENTION

Figure 1:
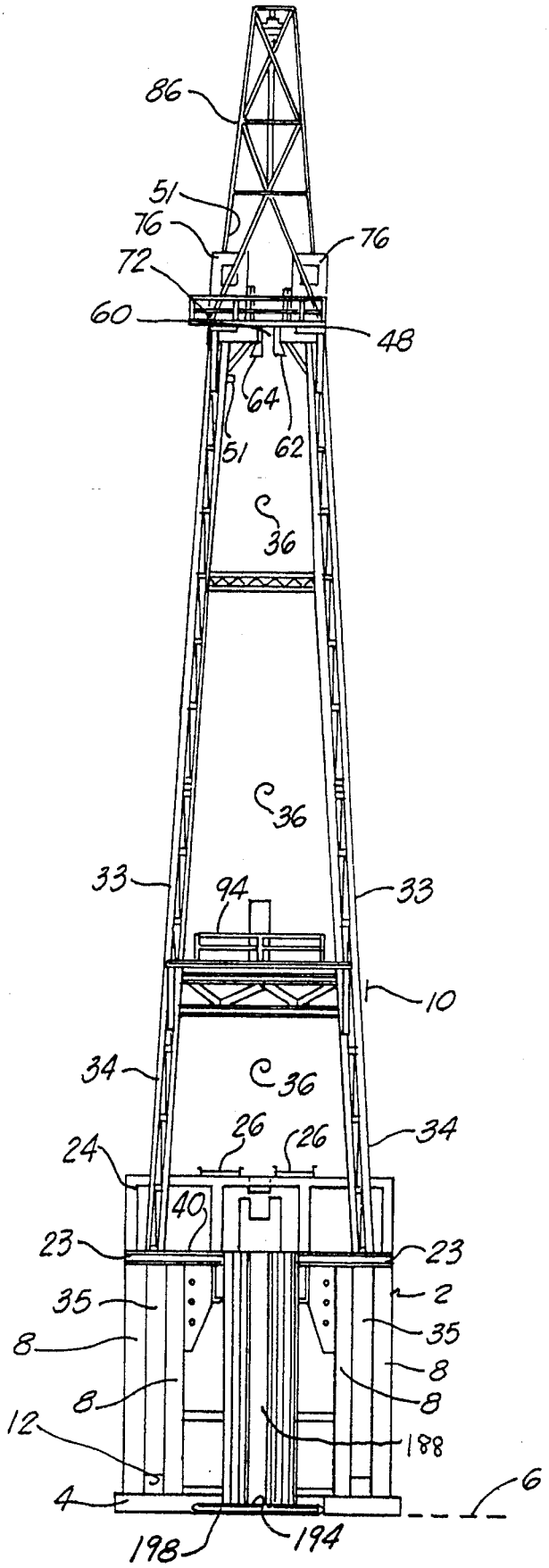
FIG. 1 is a view of mast, substructure and stand jib of the invention.
Figure 2:
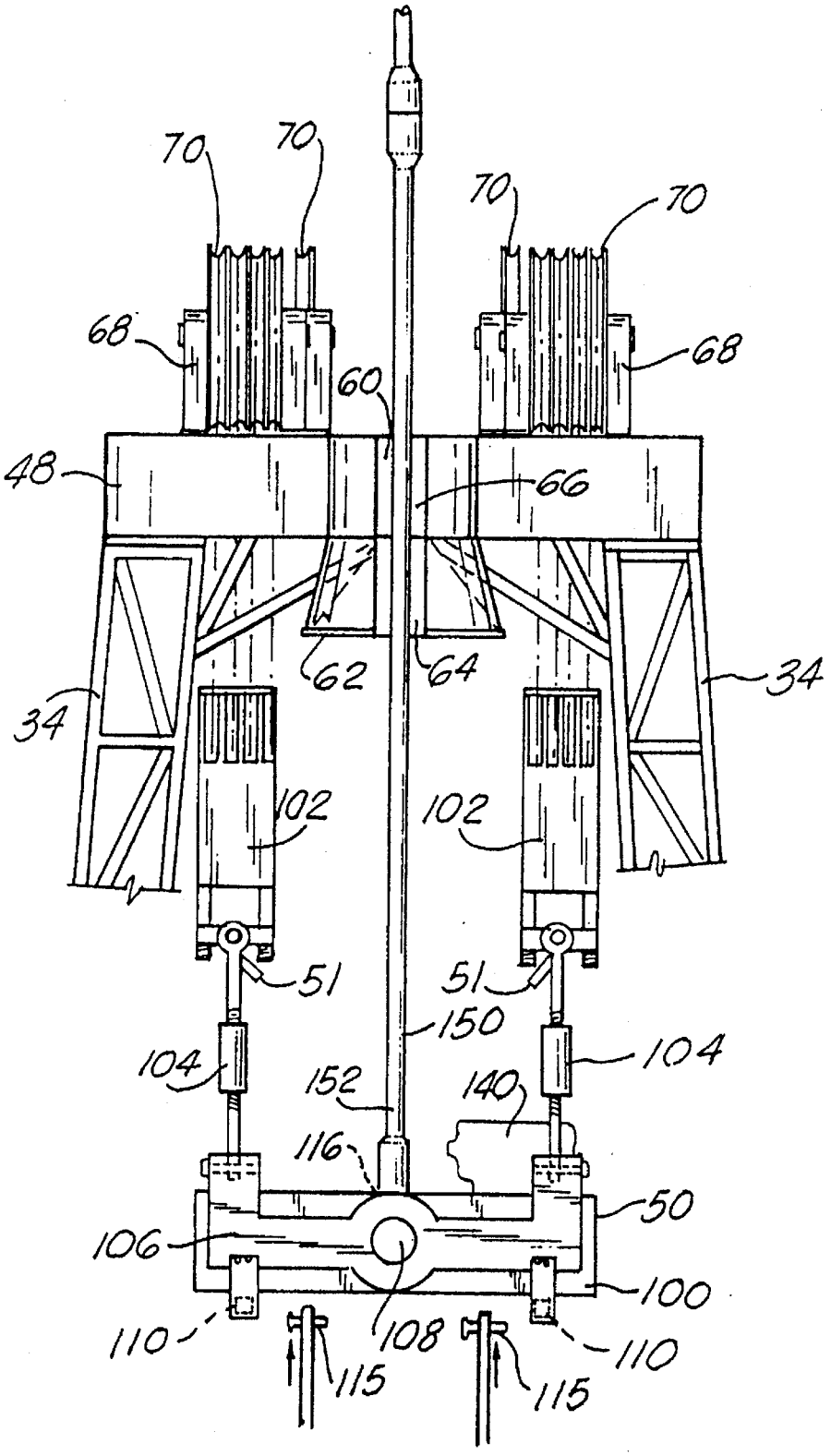
FIG. 2 is a view of the rotary elevator (rotovator) of the invention raised within the mast with drill pipe section.
Figure 13:
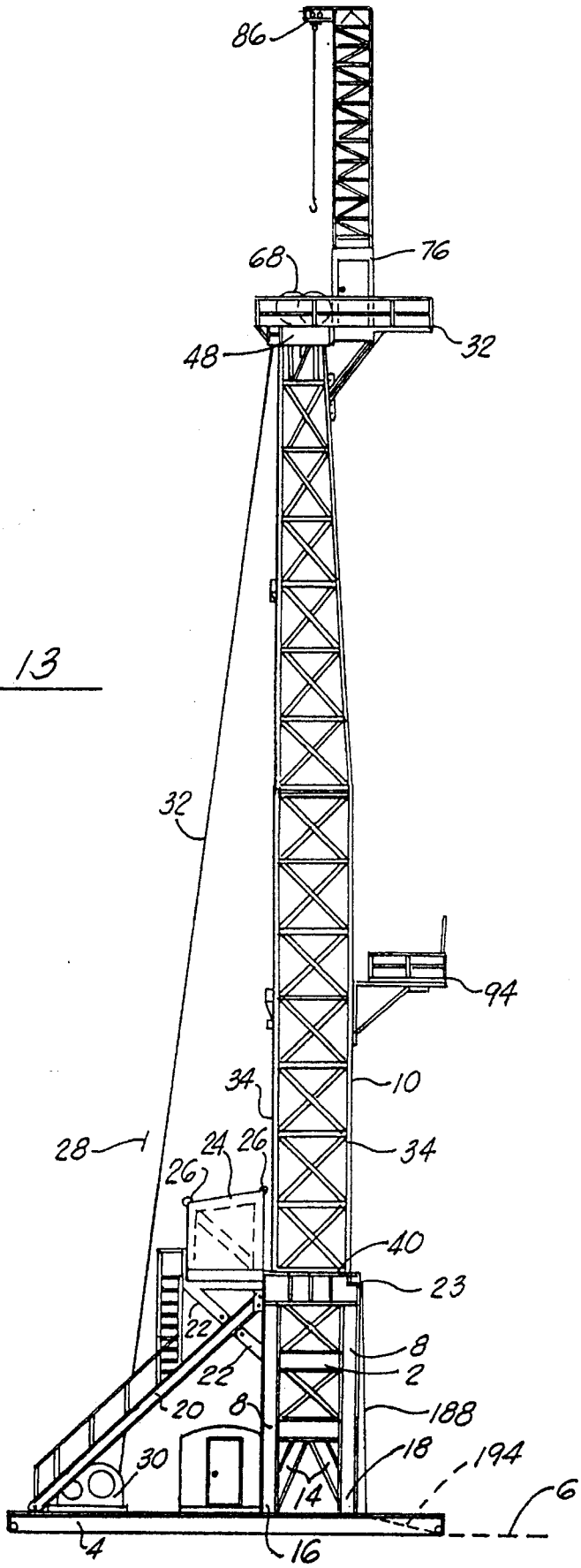
FIG. 13 is a side view of the substructure and mast of the invention.
Figure 14:
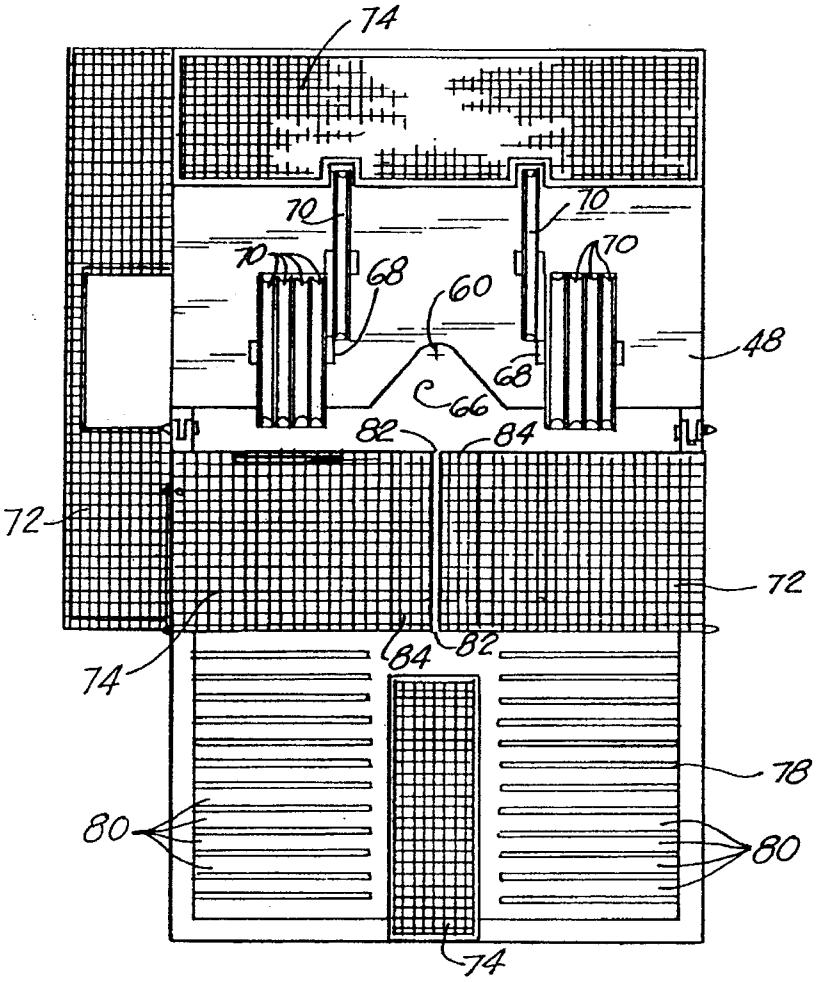
FIG. 14 is a top view of the crown structure of the rig including the fingerboards.
Figure 15:
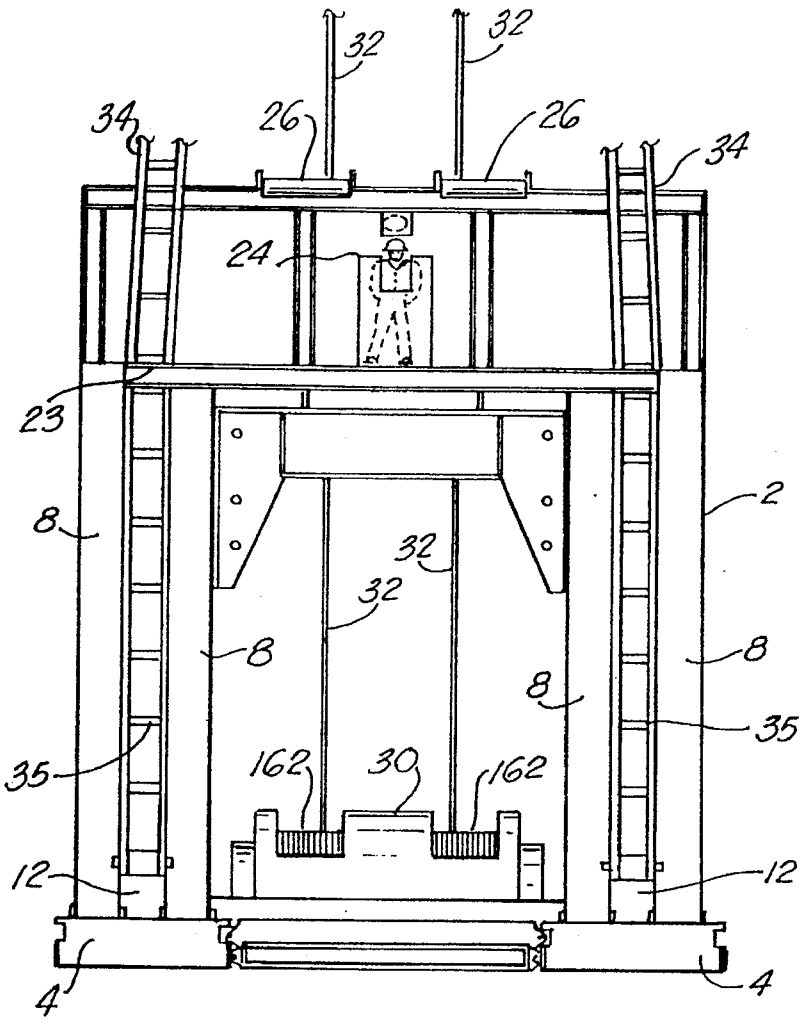
FIG. 15 is a front view of the lower mast and substructure, including the control room.

FIG. 1 and FIG. 13 show the structure of the substructure 2 and the mast 10 of an embodiment of the invention. For illustrative purposes, this embodiment is sized as a 15,000 foot depth drilling rig; it will be apparent throughout how the rig may be sized for other drilling ranges, with appropriate changes to the strength of structure and to the amount of drill pipe which is racked on the rig.

Substructure 2 comprises a 27 foot high support structure which is sufficient to cover any stack of Blow Out Preventers (BOP); such BOPs are known in the art and are not shown here. Substructure 2 is mounted on a sub base 4, two parallel I beams which form the ground level 6 support for the rig. Substructure 2 is formed of two spaced apart pairs of main beams 8, which support the weight of the mast 10. A mast receiving slot 12 is formed within each pair of main beams 8. The main beams 8 are supported by deep V pin connectors 14, which eliminate the need for additional diagonal bracing.

The substructure 2 is pivoted on rear pins 16 to the sub base 4. Upon erection, the substructure is pinnedb 55047765.001 to the sub base 4 by front pins 18. One side is shown in FIG. 13, but it is to be understood that the sub structure 2 is two sided, and an identical structure is meant on each side. Erect, the sub structure 2 is braced by gin support legs 20. Cross support legs 22 support control room structure 24, which is a braced, rectangular box structure. The control room is multi-functional. Its frame is beam in construction and is the cross member providing integrity and leverage for raising the mast. Line rollers 26 are mounted to the upper front and rear eaves of control room 24; Control room 24 also serves as a bracing member, substituting for the conventional A-Frame support, for raising the mast 10. While utilizing the space normally occupied by the draw works or catworks on conventional systems, the Control Room 24 enclosure provides a comfortable, safe, work area, while housing controls, weight indicator, make up and breakout winches, air hoists, lounge area, rest room, elevator, office, first aid station, monitors, and intercom system. It provides an out of the weather work station for the operator/driller and floorman.

A lock beam 23 secures the front of the mast and substructure at the floor level.

Figure 10:
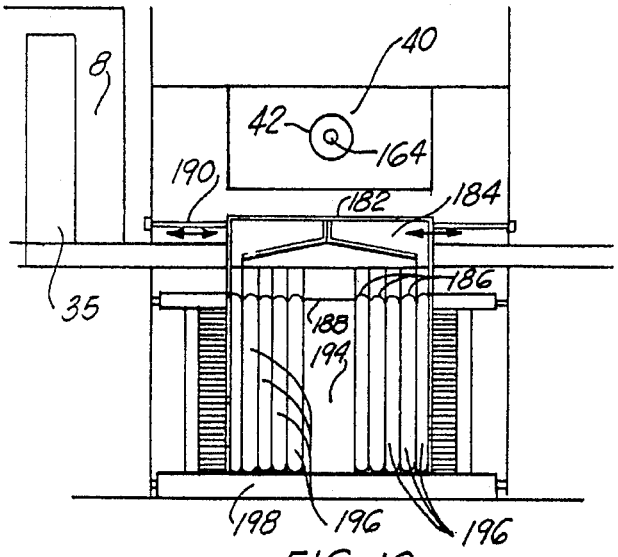
FIG. 10 is a view looking down from the mast on the racking guides of the invention.
Figure 12:
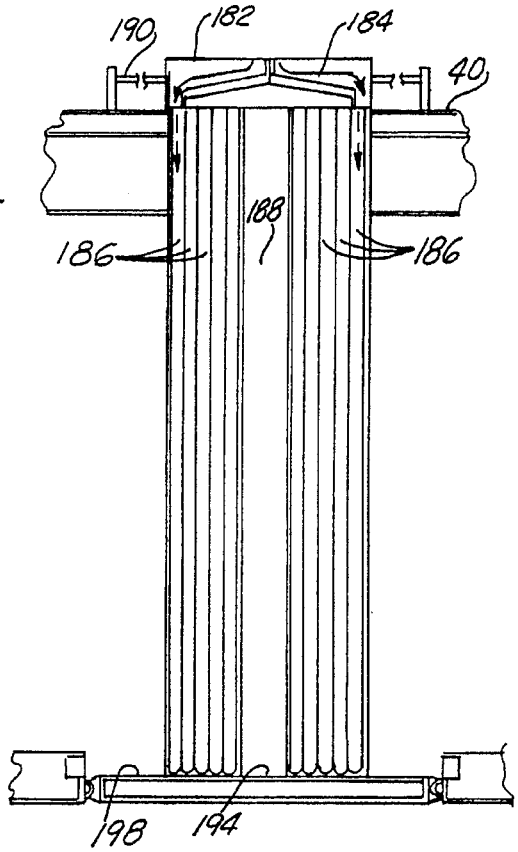
FIG. 12 is a front view of the racking guides of the invention.

A floor 40 forms the top of the substructure 4, and a conventional rotary table 42 (seen in FIG. 10) is centered on the floor 40. Rotary table 42 does not have to be powered, as it is not used for rotating the string during drilling, but for supporting the drill string 152 with conventional slips (not shown). A mechanical tong (not shown), such as the Iron Rufneck™, is also positioned on the floor.

A drawworks 30 is mounted on the subbase 4 to the rear 28 of the rig, offset behind and beneath the control room 24; this permits line 32 to pass over the rollers 26 to assist in raising the mast 10. Such mast erection procedure is otherwise conventional and well understood and is not further discussed.

The structure of mast 10 differs considerably from conventional rigs. The mast 10 is only about 96 feet in height, although, as will be shown below, it is capable of setting back 124 foot long pipe fourbles using the inventive pipe handling system.

The mast 10 is constructed of left and right side mast sections 33, each having front and rear mast legs 34, which are pinned to mast sub legs 35, which in turn fit into the mast leg slots 12, and are pinned there, interlocking the mast sub legs 35 and the substructure 2. The mast sub legs 35 extend down to within about five feet of the ground level 6, and this creates a lever arm which aids in raising the mast. Mast legs 34 are diagonally braced on each side, but the space 36 in the center of the mast 10 is completely open, and free of obstructions.

Within the open center space 36 is suspended the rotovator 50 of the invention, discussed below. At the crown base 48, directly in line above the rotary table 42 and the rotovator 50, is a pipe passing keyhole opening 60. Suspended under the keyhole 60 is a inverted mounted crown funnel guide 62, is the form of an opening funnel, having an open slot 64 corresponding to a keyhole open slot 66. On each side of the crown is a crown block 68 comprising a set of crown mounted sheaves 70 for running line to the rotovator 50. These two crown blocks 68 form a balanced support system for the rotovator 50.

At the crown level, the mast 10 also supports a racking platform 72. Platform 72 comprises walking surfaces 74 for the derrickman, and enclosed work stations 76 for the derrickman. A pipe racking board 78 provides finger board positions 80 for supporting racked stands of pipe. An open pipe transfer slot 82 runs form the keyhole 60 to the racking board 78; hinged walkway sections 84 may be flipped up to widen the transfer slot 82.

Above the racking platform 72 is erected a stand jib 86. This is a hoist of the overhead bridge crane type mounted on an A frame structure. In the illustrative embodiment, the stand jib 86 is about 35 feet high, having a 10,000 pound load capacity. This capacity and size is determined by the need to handle fourbles of pipe; the maximum load on the stand jib 86 is a stand of pipe; the stand jib never handles the entire string weight. A hoist bridge 88 allows travel from well center 90 to a point 92 behind the racking platform walkway. The stand jib assembly is preferably a removable subassembly, pinned to the racking platform as a unit for ease of rigging up and rigging down.

The mast is also equipped with a lower platform 94 which serves multiple functions as a belly board, a drill collar rack board, a stabbing platform, a platform for racking tubing, and a rotovator service access platform.

The essential features of the invention permit drill pipe to be removed from the string in lengths greater than the mast height. These features are::

(1) rotovator 50

(2) Dual Block 102/Crown Block 68

(3) Key Hole 66/Semi-Cantilever Crown Base 48

(4) Crown Funnel Guide 62

(5) Stand Jib 86

(6) The inherent rigidness of the "made up" drill string 152

The primary drill string handling is by an elevator mounted rotary table, or "rotovator" 50. This rotovator is a rectangular platform 100, attached to dual blocks 102, one on each side; each dual block 102 is attached to the rotovator 50 by two bales 104. In the preferred embodiment, these bales 104 are attached at the ends of a equalizer bar 106, one such bar on each side of the rotovator platform 100. The rotovator platform 100 is mounted to these equalizer bars 106 through a pivoting bearing 108 mounted centrally on the platform 100, permitting the platform 100 to pivot slightly with respect to the equalizer bar 106. Load balancing springs 110 are mounted between the bars 106 and the platform 100, and serve to level the rotovator 50 against the bars, to maintain the rotovator 50 level and aligned with the drill string 152 tool joints.

Each dual block 102 is capable of an 8 line string up. Two crown blocks 68 are positioned at the crown base 48 of the mast, and are spaced apart so that the dual blocks 102 are nearly underneath the mast legs 34 The crown blocks 68 are thus positioned to exert forces downward nearly over the legs 34; this maintains structural integrity, and keeps the center 36 of the mast and crown free of obstructions.

The rotovator 50 in appearance looks like a rotary table; however, it is modified to serve multi-functions. Structurally, the rotovator 50 in this embodiment is approximately 4' W×8' L×2' D. The rotovator's width, typically about eight feet, is positioned to travel inside the mast's tapering spread of legs 34, from 22' W at floor level to 9' W below the crown base 48 at 90' from floor level. The rotovator 50 only has an 8" opening in its drive because the only tools entering the rotovator are a drill stem 112 and the drill string 152. A drill stem joint 114 replaces the kelly. All other items than drill pipe, including Drill collars, core barrels, irregular tools are handled with conventional lift nipples (not shown) of rig drill string size.

The 8" maximum opening in the rotovator turn table 116 resembles an hourglass in cross section. The lower portion 118 tapers (below the rotary table bearings and movement) to form an inverted funnel (as in existing casing tools) to guide the rotovator 50 over the drill string 152.

The upper portion of this "hourglass" contains the movement 120. The upper half consists of a bowl 122 much as a slip bowl, locked to the turntable 116 by splines 126. The bowl 122 contains tool joint grips 128, forming a tool joint profile 130 interior with a stepped bowl exterior 132, that are locked to the rotary table 116 for rotational movement by splines 126. There are preferably four tool joint grips 128 which are operated vertically by an air piston 127, much as the power slips in use today. The tool joint grips 128 are also slotted 134 on their inner faces 136. The slots 134 match splines 138 on a drill stem 112. When the drill stem 112 joint in not in use, such as for trips, the slots 134 are empty. Unlike a slip grip, the tool joint grips 128 do not require 360 degrees full contact onto a tool joint.

Figure 3:
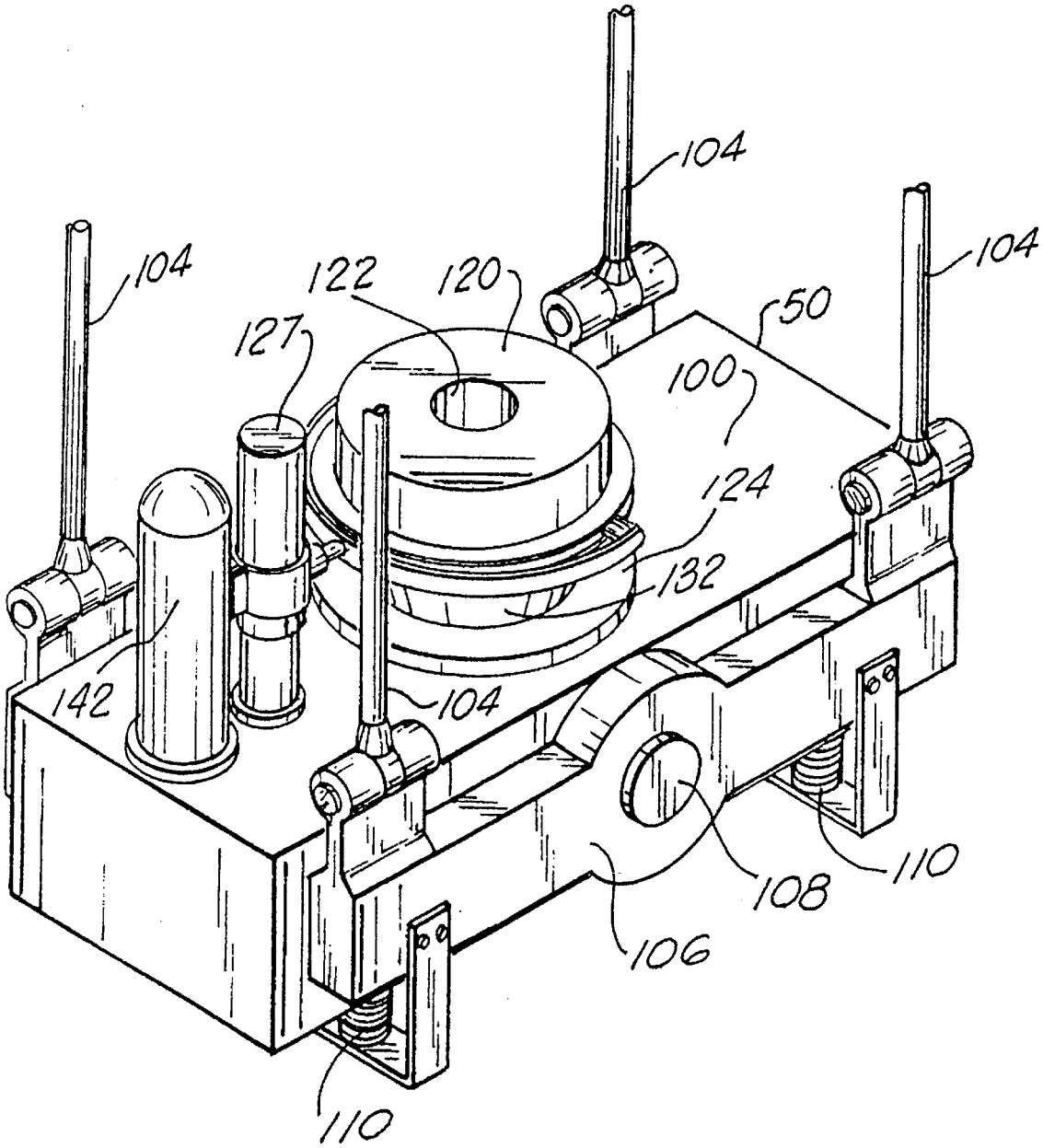
FIG. 3 is an angled view of the rotovator of the invention.
Figure 5:
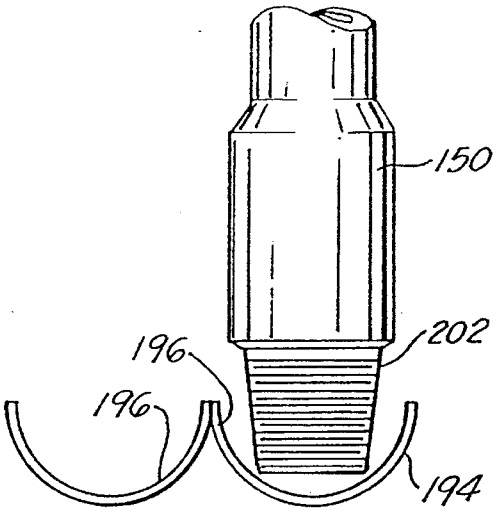
FIG. 5 is a view of a drill pipe tool joint aligned within a racking guide of the invention.
Figure 4:
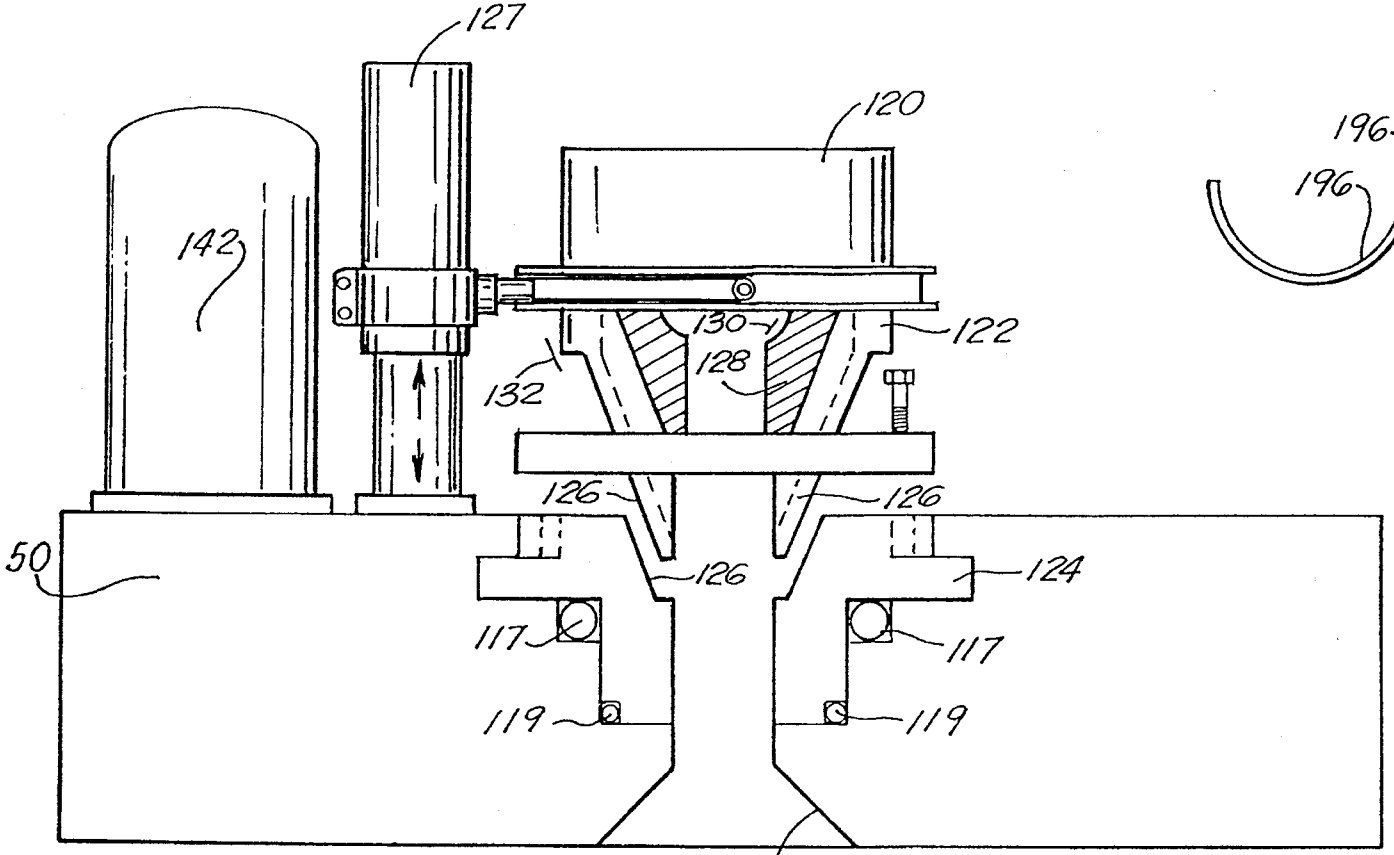
FIG. 4 is a side section view of the rotary and slips within the rotovator of the invention.
Figure 6:
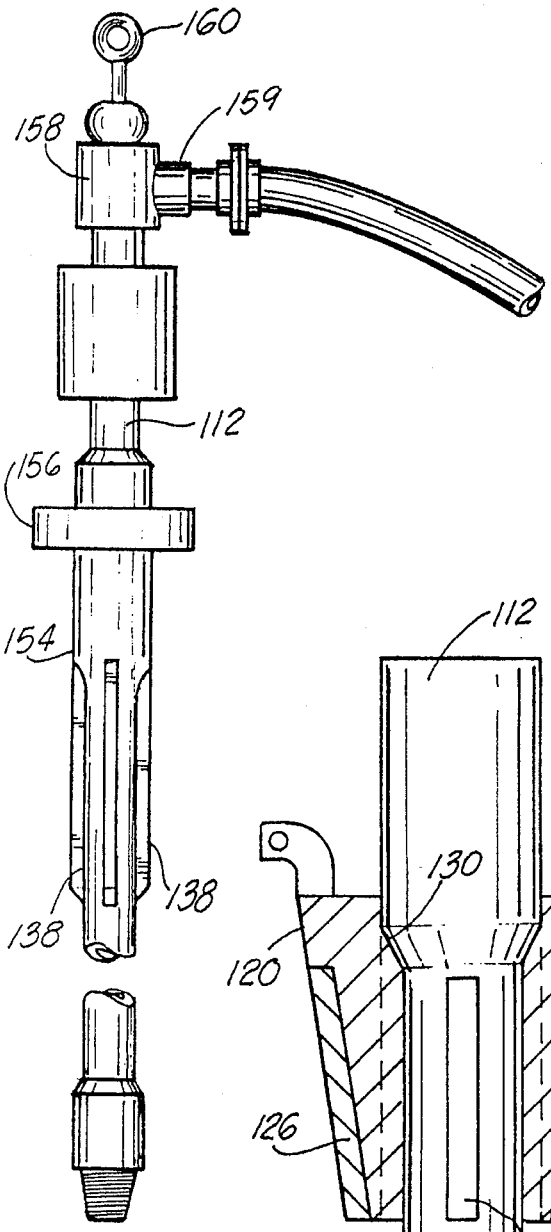
FIG. 6 is a view of a drill stem joint of the invention.
Figure 9:
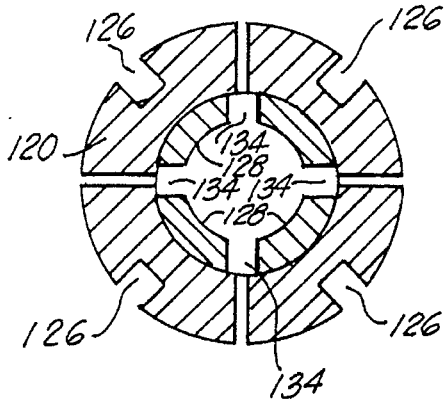
FIG. 9 is a top section view of the elevator mounted rotary and slips of the invention.
Figure 7:
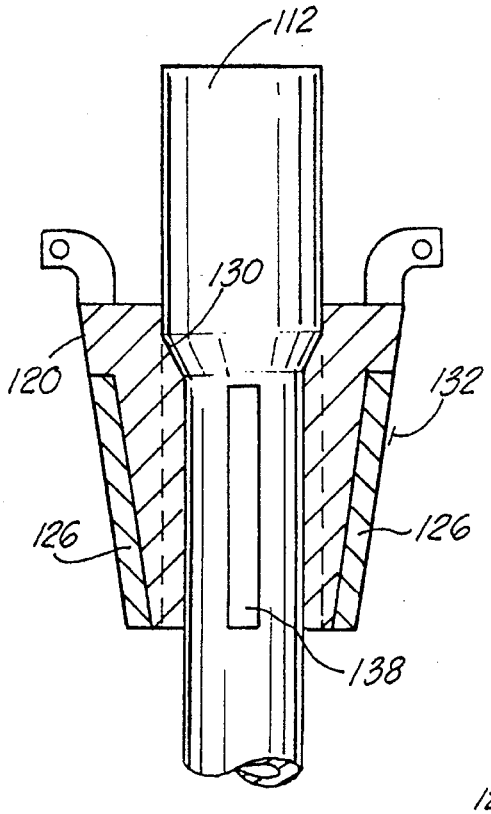
FIG. 7 is a detailed view of the drill stem within the elevator mounted rotary of the invention.
Figure 8:
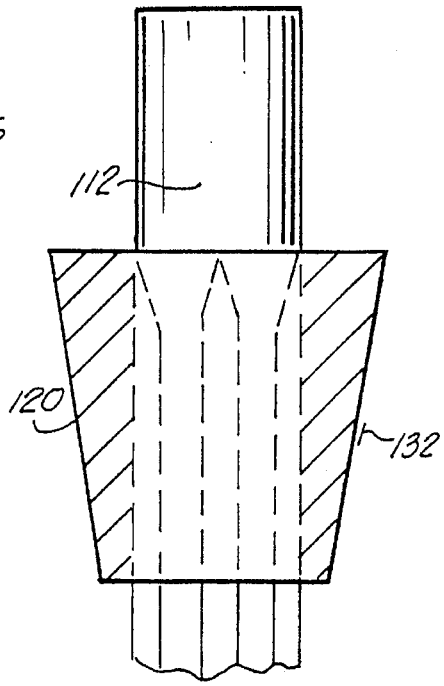
FIG. 8 is a second view of the drill stem within the elevator mounted rotary of the invention.

Drive is accomplished by a top mounted GE 761 Drill Motor 140 (not shown on FIGS. 3 and 4 for clarity) or equivalent powering through a power band to a typical rotary drive arrangement. The Drill Motor 140 rotates the table 116, the table 116 rotates the locked bowl 122, the bowl 122 rotates the tool joint grips 128, the tool joint grips 128 engage and rotate the drill stem 112 joint, the drill stem 112 joint rotates the string 152.

The rotovator 50 has a typical rotary table type drive 116 and therefore has ball bearings 117 designed to rotate under string loads equal to rig rating, as well as radial thrust bearings 119. The rotovator 50 should be equipped with the equalizer bar 106 on larger rigs. However, it can be directly connected to the bales 104 via the platform 100 if desired. In this case, four bales 104 (two per side) attach to the dual blocks 102 by means of a doubletree type assembly and are mounted with coil springs on each for shock removal.

Figure 11:
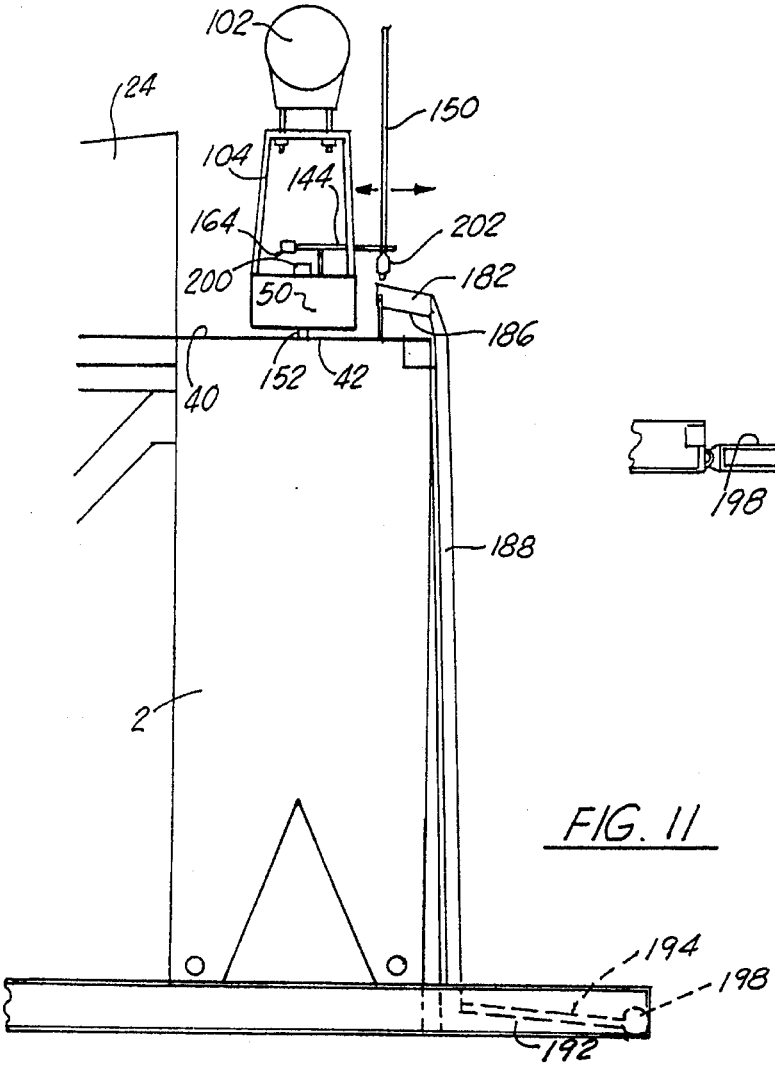
FIG. 11 is a side view of the racking guides and ground rack assembly of the invention.

The rotovator assembly 50 has an air reserve tank 142 mounted on the opposite side from the drive motor 140. The air reserve tank 142 is for tool joint grip operation and operation of a short stroke stabber arm 144 (only shown on FIG. 11) for pushing pipe stands 150 to the pipe rack 180 and for stabbing when going in the hole. The air supply is renewed by conventional supply from rig compressors through a 1" air hose bundled with the rotary hose and electric motor and control lines (not shown for clarity, as running such lines from crown to traveling block is known in the art). The hose cluster rides the rotovator assembly 50, even while tripping.

To aid in automatic or centralized control of the rotovator 50 and the rig, closed circuit television cameras 51 are mounted on the bales 104, in position to view all equipment operation on the rotovator 50. In addition, such television cameras 51 may be mounted on the rig at the racking platform 72 and also to view the floor 40. Monitors for each television camera 51 would be placed in the control room 24, visible to the driller.

Within the rotovator 50, drill string 152 is suspended from and driven by a drill stem joint 112. The drill stem joint 112 is a length of X-95 or 4140 steel drill stem with an extra long pin base and an overall length of about eight feet, including an upper tool joint 154. With a drill pipe safety valve installed, the drills stem 112 protrudes beneath the rotovator 50 about 8 feet. The box portion of the drill stem 112 has machined splines 138, preferably four, on an extra long 6¼" OD tool joint. Above the tool joint is a 10" OD donut flange 156 which is an integral part of the drill stem. At the upper end of the drill stem 112 is a 10,000 lb. test straight swivel joint 158. Made up into the swivel joint 158 is a nipple, tee, and horizontal outlet 159 for pump tie in, vertical outlet for "bull" plug and lifting eye 160. The tee outlet 159 will have a union for disconnect to rotary hose, and the "bull" plug will have a lifting eye 160 fabricated on top for drill stem removal.

The dual blocks 68 hoist the rotovator 50 at each end, thereby allowing the center 36 of the mast to be free of obstructions which would limit pulling pipe through the crown keyhole 66. 4½" and larger drill pipe is relatively stiff when made up in the string. This stiffness allows up to two sections (a double) of drill pipe to stand free of support above the rotovator and still center within the crown funnel guide 62. By virtue of this duality, the dual blocks 102 and drilling lines 32 will be smaller. 1⅛×" lines strung 8 per side will give a safety factor of 2.4 based on SHL of 700,000 lbs. The smaller drill line 32 and the shorter hoisting distance (62' at the time) will make for precision spooling, especially with the heavy traveling equipment.

The two dual blocks 102 and the crown blocks 68 are run with two drilling lines 32, which are run to a modified draw works 30 which provide a double drum hoist 162. A basic drive unit suitable for this function would contain two drive motors (GE 752 type) driving a 2 or 3 speed transmission, in turn driving the drum shaft; a Dynamic Braking System would be attached to the drum shaft. No special drum is anticipated; for example, a large capacity single drum can be segregated with a center flange, and provisions made for a drill line terminal on each side. Grooving and kick plates must be exchanged for the accommodation of the smaller drilling lines. Spooling space is not a problem, as the invention 2 will only require spooling capacity of 800'± on each side when strung with maximum lines. By comparison, the larger draw works drums 162 were built to accommodate 1200'+ of 1⅜"–1½" drill line. The smaller line, heavy traveling equipment, and steady or constant speed will allow uniform spooling.

The rig will not run in the manner that rigs are today, as constant motion will be the key, versus "90 miles an hour to dead stop in 30 seconds" as in conventional tripping. The draw works 30 gear ratios will be set to hoist, at maximum loads, 60'± pipe per 60 seconds and the empty hoist speeds (high gear) will be at a speed where the assembly does no coasting/line backlashing upon drum clutch release. Again, constant motion, not speed is the key to smooth operation.

Pipe racking is accomplished on a drill pipe ground level rack 194, which is best described functionally. Drill pipe is racked in fourbles 150 as follows: upon removal from string 152, the stand 150 is: (1) picked up by the stand jib 86, (2) pushed horizontally from the well bore 164 over a pipe rack guide box 182. This can be accomplished automatically by a pneumatic stabbing/unstabbing arm 144 of standard design mounted on the rotovator 50 and operated by the floorman, (3) lowered into the pipe rack guide box 182 by the stand jib 86. Pipe rack guide box 182 has two guide channels 184, set at an inclined plane 186. The guide box 182 slides laterally along a guide rod 190, so that the guide channels 184 may be set in line with a specific vertical guide trough 186, out of the plurality of parallel vertical guide troughs 186 on the vertical guide 188. As the pipe stand 150 is lowered into the guide box 182 the pipe stand 150 pin end 202 follows the guide box channel 184 along an inclined plane 186, leaving the guide box channel 184 and exiting into the selected trough 186 of the vertical guide 188. The angle of the stand 150, and the fact it is supported from the top with no downward weight, causes the stand 150 to "stay in the groove", (5) continued lowering causes the stand 150 to reach the inclined plane 192 of a ground level pipe rack 194. The ground level pipe rack 194 is set at an inclined plane 192, lowering away form the rig; there are ground level troughs 196 corresponding to each vertical guide trough 186, and acting as a continuation of that vertical guide trough 186. Pipe rack trough 196 is curved so that the pin end 202 of the stand 150 follows the trough, but the threaded portion of the pin end 202 does not contact the trough sides, and no possibility of thread damage occurs. The pin end 202 of the lowered stand 150 follows the trough 196 until it bumps up against a buttress beam 198 which blocks the end of the pipe rack 194 or the previous stand 150 set back in the trough 196. (6) At this point, the derrickman props the upper end of the stand 150 at the working platform 72, removes stand clamp, and pushes the pipe in the selected finger 80.

In use the invention is best shown by an illustrative operation setting and removing pipe.

For example, to trip in the hole, the rotovator 50 is in position at the rig floor 40, with the tool box 200 of the string 152 extending above the rotary table on the rotovator 50. The derrickman picks up a fourble 150 by the stand jib 86. The stand (fourble) 150 is raised through the crown keyhole 66 until the bottom of the fourble is above the string tool box 200. The pin end 202 of the stand is then guided into the tool box 200, which aligns the string 152.

At this point the connection between the drill pipe sections is aligned but is not made. The drill string 152 is supported by slips in the rotary table 42 mounted in the substructure floor 40. The rotovator 50 is then hoisted above the unmade connection to the position of the second tool joint. While the rotovator is being hoisted, the joint is made up, connecting the fourble 150 into the drill string 152.

The rotovator 50 rotary grips 128 are then closed on the second tool joint. The slips at the floor rotary table 42 are opened, and the rotovator 50 supports the entire drill string 152, with two sections (a double) beneath the rotovator 50 and a double above the rotovator 50.

The rotovator 50 is then lowered to lower the double down hole; the floor rotary 42 slips are then set to support the string 152, the rotovator grips 128 are opened and the rotovator 50 is raised to the top tool joint.

The rotovator grips 128 are then latched onto the top tool joint, the floor rotary 42 slips are opened and the second half of the fourble 150 is lowered to floor level 40. The process is then repeated until bottom is found.

Upon reaching bottom, the rotovator 50 is then raised, the drill stem 112 inserted in the rotovator rotary 124, and the drill stem joint 112 joined to the drill string 152. The drill stem 112 is connected to drilling fluids, in the manner known in the operation of drill rigs, and then drilling is commenced by rotating the rotovator's 50 drive mechanism 124, driving the drill stem 112.

Drilling and connection of additional sections are done as follows.:

Upon rotovator and drill stem joint being down, hoist drill stem and one single out, stop pump, set floor rotary 42 slips. Since there is no kelly drive bushing required in the floor mounted rotary 42, conventional air slips may be installed in the floor rotary 42, and these air slips would preferably be used..

Break out the drill stem from the string with Iron Rufnek (rotary table or rotovator can also be used for spinning out).

Push end of the drill stem to a single joint in mouse a hole with an air cylinder arm (operated by floorman).

Make up drill stem to single with rotovator and a mouse hole grip (backups).

Pick up the single out of the mouse hole, make up in string, torque with Iron Rufnek or with the rotovator.

Turn pump on, open slips, find bottom, and drill.

To trip out, the procedure is:

Pick up the string to a tool joint, stop pump, set air slips (note: air slips reside in floor rotary table 42 in open position while drilling), break off joint and drill stem joint.

Derrickman disconnects rotary hose from drill stem joint, hooks onto drill stem joint eye with an air hoist line; drill stem joint and single are removed and hung from a hook located at the belly board 94, at the junction of the frame and mast, with lower end hanging off the floor. Derrickman resumes journey to upper racking platform 72.

Driller/Operator hoists two joints and then sets air slips. He opens grips 128 in rotovator and lowers rotovator assembly to floor, closes grips 128. picks up the string, and opens air slips.

At this point, there is a free standing double of drill pipe above the rotovator. The pipe will stand fairly rigid due to its own characteristics and being "made up" in the string. As the third single comes through the rotary table, the top of the string will be entering the funnel guide underneath the crown. When this is observed on monitor, the operator will pull fourth single, break out and release the fourble, lower rotovator to floor.

While "breaking out", the derrickman latched the stand jib clamp around this fourble, took slack out of his line, (which stopped pipe from bellying after breakout) while rotovator goes back to floor. Upon seeing and hearing the rotovator in latching on position, derrickman picks fourble up out of string tool box 200. An air stabbing/unstabbing arm 144 on the rotovator extends (floor helper operated) and pushes the pipe stand 150over the guide box 182. Derrickman lowers fourble which self racks at ground level as previously described, and removes stand jib clamp from fourble.

Repeat processes, pulling out of hole to Bottom Hole Assembly (BHA). At this point tripping has been done with three men-driller, derrickman, floorman.

The procedure for handling the Bottom Hole assembly recognizes that this assembly is too large in diameter to fit through the rotovator opening 122. Therefore the following procedure is followed:

Typically, at this point, bring up the fourth crew member (maintenance man) to help remove the air slips and slide back Iron Rufnek. Then swing around manual tongs that may be mounted on pivoting 8' jibs for working underneath the rotovator.

Make up Lift Nipple and pull drill collar double with rotovator latched onto lift nipple.

Break out the drill collar double.

Rack drill collars in doubles directly behind and each side of rotary table through removable plates. (The stands when racked are not at a severe angle to the well center).

Upon the stand reaching its rack point underneath the floor, driller opens rotovator and picks the rotovator up, clearing the drill collar double, while derrickman racks top end at the lower racking platform.

Repeat process until out of hole. Go in hole with the bottom hole assembly by repeating processes in reverse order . . . back to three man operation.

It can readily be seen how casing, casing tools and unusual or small strings can be handled. All such items can be handled as singles or doubles by attachment to pad eyes 115 beneath the rotovator, using the rotovator as a traveling block.

The invention thus permits a smaller mast and rig to handle drill pipe in multiple sections than would be possible with a conventional rig where the crown structure must be above, and strong enough to support, a centrally mounted crown block and traveling block above the drill string. By combining the rotary with an elevator, balanced under the side legs of the mast, drill string can be handled in multiple sections longer than the mast is tall. Further, by placing the rotary on the elevator structure, the need for a kelly and kelly drive is eliminated, and longer sections of drill pipe can be drilled before tripping in more pipe.

The following is a chart comparison of moving loads of 25'–30'. High Box×Box Sub, 142' Mast, SCR Convention Rig vs. 2×4 DHS.

| Load No. | Description | Pieces |
|---|---|---|
| | CONVENTIONAL | |
| 1 | Sub Box | 1 |
| 2 | Sub Box | 1 |
| 3 | Sub Box | 1 |
| 4 | Sub Box | 1 |
| 5 | Sub Box | 1 |
| 6 | Sub Box | 1 |
| 7 | Spreaders | 7 |
| 8 | Kelly Slide, Stairs, Rat Holes | 4 |
| 9 | Top House | 1 |
| 10 | A-legs, Starter Legs | 2 |
| 11 | First (Section) Half | 1 |
| 12 | First (Section) Half | 1 |
| 13 | Intermediate section | 2 |
| 14 | Upper Section | 2 |
| 15 | Crown Section | 1 |
| 16 | Racking Boards | 2 |
| 17 | Rot., Swivel., B & H | 4 |
| 18 | Catwalks, Kelly, Stairs | 5 |
| 19 | Pipe Racks | 6 |
| 20 | Pipe Racks | 6 |
| | "2 × 4 DHS" | |
| 1 | Sub Box Base | 1 |
| 2 | Sub Box Base | 1 |
| 3 | Spreaders, Gin Legs | 5 |
| 4 | Pipe Ramp & Rack | 2 |
| 5 | Control Room | 1 |
| 6 | Data Room | 1 |
| 7 | Mast Sections | (3) |
| 8 | Mast Sections | (3) |
| 9 | Crown & Base | 1 |
| 10 | Pipe Jib | 1 |
| 11 | Racking Platforms | 2 |
| 12 | Rotary, Blocks, Rotovator | 3 |
| 13 | 6" H Catwalk & Racks | 14 |
| 14 | Stairs, Misc. | 6 |

I claim:

1. A drill rig comprising:

a substructure supporting a mast;

a drill rotary mounted in an elevator suspended by twin blocks within said mast, said elevator being supported at each end thereof;

said mast having an open central area for free passage of drill pipe therein;

means within said rotary for gripping drill pipe tool joints for movement vertically; and means within said rotary for rotating said drill string.

2. The drill rig of claim 1 further comprising:

a crown structure in said drill rig;

an opening within said crown structure adapted for vertical movement of drill pipe sections above said mast.

3. The drill rig of claim 1 said rotary comprising:

a motor driven rotary table;

said rotary being split into multiple slip jaws;

means, responsive to movement of an air piston for closing said slip jaws upon a drill pipe tool joint.

4. The drill rig of claim 1 said rotary further comprising:

a motor driven rotary table;

said rotary being split into multiple slip jaws;

means, responsive to movement of an air piston for closing said slip jaws upon a drill pipe tool joint;

a plurality of spline receiving grooves within said rotary and a drill stem comprising:

a tool box joint above a section of drill pipe;

splines on said pipe below said box joint, said splines mating with said grooves for rotation of said drill stem by said rotary; and means for connecting said drill stem to a drill string and to a source of drilling fluid for drilling.

5. The drill rig of claim 1 said elevator further comprising:

a rectangular platform extending across the interior of said mast;

said platform having a centrally positioned joint about which the platform pivots;

two support beams pivotally affixed to said centrally positioned joint on each of two opposed sides of said platform;

said support beams being connected at the ends thereof to two traveling blocks, said blocks being suspended adjacent the legs of the mast;

means for biasing said platform to a level position with respect to said support beams.

6. A process for handling drill pipe within a drill rig comprising the following steps:

a) providing a rotary for receiving said drill pipe centrally positioned on an elevator;

b) suspending said elevator by the ends thereof from opposed balanced travelling blocks;

c) providing means for gripping drill string tool joints within said rotary;

d) lowering said elevator to a floor level;

e) gripping a first tool joint in said rotary;

f) raising said elevator to pull a first multiple section of drill pipe up within the rig;

g) lowering said elevator until said multiple section of drill pipe is above said rotary;

h) gripping a second tool joint beneath said multiple section of drill pipe in said rotary;

i) raising said elevator to pull a second multiple section of drill pipe up within the rig; and j) breaking off said first and second multiple sections of said drill pipe as a unit.

* * * * *